US006655463B2

(12) United States Patent
Saliés

(10) Patent No.: US 6,655,463 B2
(45) **Date of Patent: *Dec. 2, 2003**

(54) METHOD FOR DRILLING AND COMPLETING OIL WELLS WITH SMALL INTERMEDIATE DIAMETERS

(75) Inventor: Jacques Braile Saliés, Rua Gustavo Sampaio (BR)

(73) Assignee: Petroleo Brasileiro S.A._Petrobras (BR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/241,412

(22) Filed: Feb. 2, 1999

(65) Prior Publication Data

US 2001/0020533 A1 Sep. 13, 2001

(30) Foreign Application Priority Data

Feb. 3, 1998 (BR) ..... 9800535

(51) Int. Cl.[7] ..... E21B 17/00; E21B 19/16
(52) U.S. Cl. ..... 166/380; 166/348
(58) Field of Search ..... 166/382, 380, 166/285, 348

(56) References Cited

U.S. PATENT DOCUMENTS 3,666,009 A * 5/1972 Stone ..... 166/335
4,601,343 A * 7/1986 Lindsey, Jr. et al. ..... 166/382
5,884,702 A * 3/1999 Yokely et al. ..... 166/290
5,918,674 A * 7/1999 Head ..... 166/348
5,918,677 A * 7/1999 Head ..... 166/380

FOREIGN PATENT DOCUMENTS

EP 0 572 261 12/1993

OTHER PUBLICATIONS

Bourgoyne, Jr. et al., Applied Drilling Engineering, 1991, Society of Petroleum Engineers, vol. 2, pp. 300–301, 330–331, 333–335, and 339.*

Burdylo et al, "*Primary Cementing Techniques*", 1990, Schlumberger Educational Service.

Lindsey et al, "*Designing and Equipping Deep High Pressure Anadarko Well Completions*", Oct. 1978, Society of Petroleum Engineering.

* cited by examiner

*Primary Examiner*—William Neuder
*Assistant Examiner*—Jennifer H Gay
(74) *Attorney, Agent, or Firm*—Nixon & Vanderhye PC

(57) ABSTRACT

A method for drilling and completing oil wells of small intermediate diameter, in particular for application in ultra deep water. The method includes two drilling and running stages. The first stage of drilling and running provides for drilling the well and running at least first and second casings. The second stage provides for drilling and running at least two and more preferably three suspended liners.

6 Claims, 2 Drawing Sheets

METHOD FOR DRILLING AND COMPLETING OIL WELLS WITH SMALL INTERMEDIATE DIAMETERS

FIELD OF THE INVENTION

This invention relates to a method for the drilling and completion of oil wells of small intermediate diameter for application in ultra deep water.

PRIOR ART

One of the major problems currently faced by operation and oil production in deep water is that of finding drilling and completion rigs on the market at an accessible cost.

The development of operations in deep waters has experienced a growing impetus with new technologies which reduce design time and cut costs. Thus for wells in deep water the time from discovery to the start of production is gradually falling, as is the appraisal work. The normal period between discovery and first production is continually tending to decrease.

The decision to operate in deep water restricts the availability of specialist equipment, particularly drilling rigs, increasing the development cost. Thus the contracting of vessels for deep water work has proved to be quite difficult because of their scarcity on the market, which results in an increase in the cost of chartering these vessels.

The availability of rigs at accessible prices for carrying out oil drilling and completion operations in deep waters is essential if oil production is to be increased.

As one way of making such equipment available, there is the option of modifying existing vessels for operations involving deeper wells. Nevertheless, because of the increase in load resulting from the greater length of riser which is needed to reach greater depths, this task involves the need to make a considerable increase in the available space on the vessels and to increase their buoyancy.

At the present time the risers used in oil exploration and drilling are 21 inches (53.34 cm) in outside diameter. Wells are typically drilled in five stages, each characterized by drilling with a particular diameter. During the first stage the tools used permit the use of 30 inch (76.20 cm) outside diameter casing. Casing of 20 inches (53.34 cm) outside diameter is used in the second stage. Casing of 13⅜ inches (33.97 cm) outside diameter is used in the third stage. The fourth stage uses 9⅝ inch (24.45 cm)outside diameter casing. Finally, the fifth stage uses a suspended pipe, known by specialists as a liner, of 7 inches outside diameter (17.78 cm), supported by the casing of immediately greater diameter.

It should be emphasized that the casings extend from the wellhead to the ends of the stages drilled to their specific diameters. The liner is a pipe placed in the well and of limited length sufficient to occupy only a particular part of the well, which has been drilled to its diameter and which extends from its lowest point within the well to a point located at a particular depth below the wellhead. In other words, the liner does not occupy the entire length of the well, but only part of it.

OBJECTS OF THE INVENTION

This invention aims to propose a method which overcomes the problems mentioned above.

It is another object of this invention to establish a method whose use will reduce the cost of drilling and operating oil wells drilled in ultra deep water. This cost reduction is brought about by reducing the intermediate diameters of pipes used in the various stages of well drilling, and also by reducing the weight of the rising tubing used in drilling operations, known by those skilled in the art as the "riser", which makes it possible for vessels currently used in shallower waters to operate in deeper waters.

SUMMARY OF THE INVENTION

This invention provides a method for drilling and completing an oil well of small intermediate diameter in ultra deep water that comprises a first stage of drilling and running at least two casings and then a second stage of drilling and running at least two suspended liners, in which a first liner is fixed to a lower end of a last run casing of immediately greater diameter and the second and any subsequent liners are successively fixed to a lower end of a respective previously run liner of immediately larger diameter.

In a preferred embodiment of the method according to this invention includes: a first stage incorporates the phases of:

drilling and running a first casing, and drilling and running a second casing, and a second stage with the phases of:

drilling and running a first liner, drilling and running a second liner, drilling and running a third liner.

This method provides the opportunity for a significant reduction in well drilling costs, in respect of both the material used in drilling and completion, and materials used in support equipment for drilling operations.

BRIEF DESCRIPTION OF THE DRAWINGS

Merely by way of example, the method according to the invention will now be described in greater detail together with the drawings below which supplement this description, of which they are an integral part. In the drawings.

DETAILED DESCRIPTION OF THE PREFERRED EMBODIMENT OF THE METHOD

Figure 1:
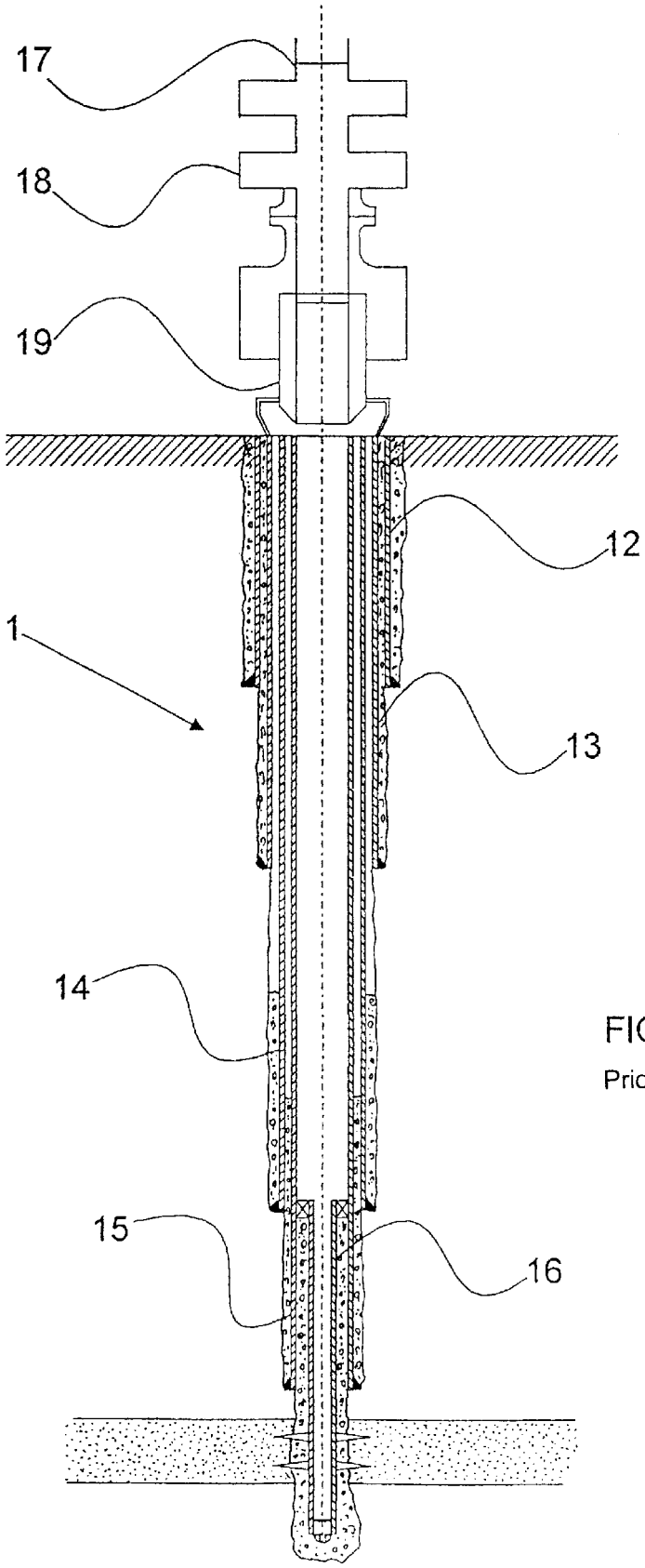
FIG.1 Prior Art
FIG. 1 is a view in cross-section of a well, drilled and lined in accordance with the prior art.

Before we begin to describe the method according to this invention, reference should be made to FIG. 1, which shows a well which has been drilled and lined in accordance with the prior art. This shows a well (1) with its various casings, that is, the first casing (12) of 30 inches outside diameter (76.2 cm), a second casing (13) of 20 inches (50.8 cm) outside diameter, a third casing (14) of 13⅜ inches (33.97 cm) outside diameter, a fourth casing (15) of 9⅝ inches (24.45 cm) outside diameter, and finally the suspended liner (16) with an outside diameter of 7 inches (17.78 cm).

It will be seen that, with the exception of suspended liner (16), all the units of casing extend down from the wellhead on the seabed to their furthest point within the well.

As can also be seen, a blow-out preventer (BOP) (18) is located at the lower end of a riser (17) which is connected to the wellhead region (19).

It is worth pointing out that, merely for the purposes of simplifying the description, the method of operating and installing blow-out preventer (BOP) (18) and riser (17) will not be described in detail here as they are well known to those skilled in the art, and furthermore they do not form an integral part of the method according to this invention.

Likewise, the manner in which liner (16) is fixed to the fourth casing (15) will not be described here, because this is a procedure which is well known in the art, and therefore needs no description.

Figure 2:
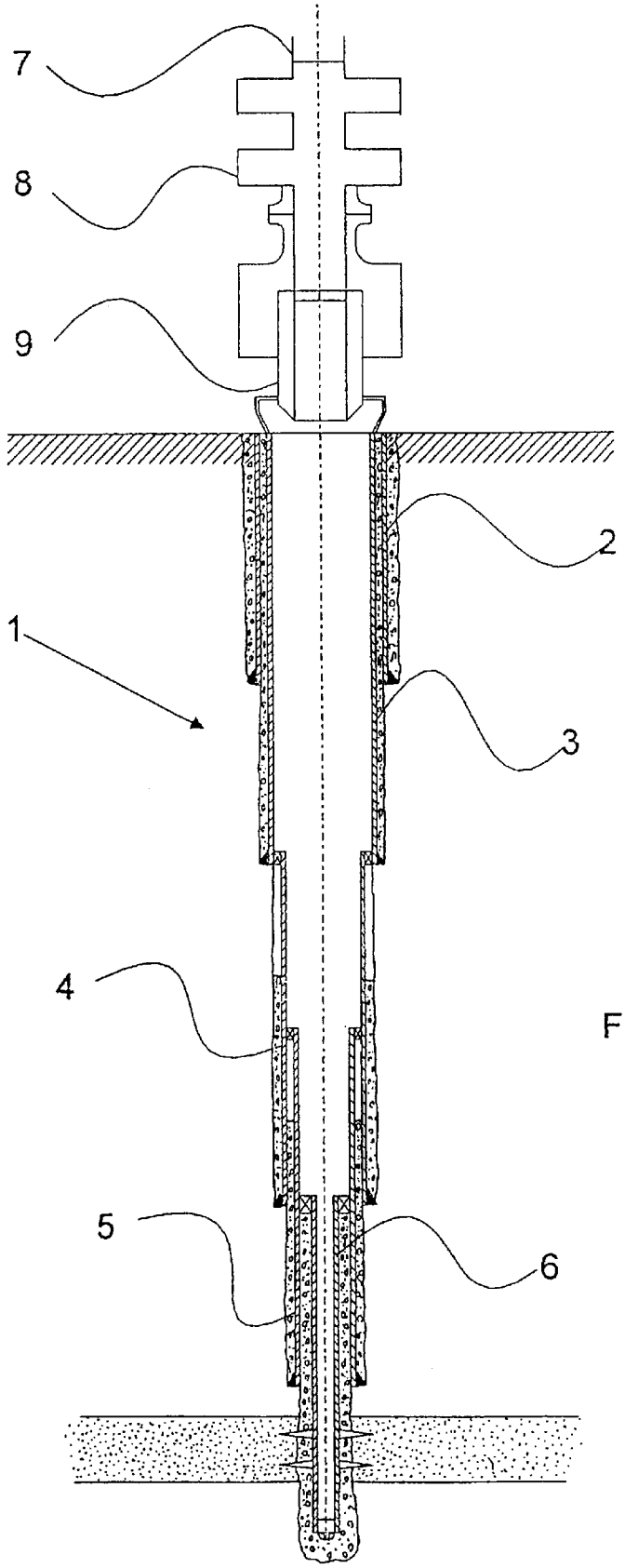
FIG. 2 is a view in cross-section of a well of smaller diameter which has been drilled and lined using the method according to the invention.

FIG. 2 shows a view in cross-section of a well (1) drilled using a preferred embodiment of the method according to this invention.

In a first stage of this method the bore is drilled and the first casing (2), which serves as a base for the well (1) having a typical outside diameter of 30 inches (76.20 cm), is run. This stage is identical to the drilling of a conventional well.

A second stage is then carried out, comprising drilling and running a second casing (3). This casing has a typical outside diameter of 13⅜ inches (33.97 cm), which is less than that normally used for the second casing (13 in FIG. 1) in a conventional well, which would be of the order of 20 inches (50.80 cm). This smaller diameter means that this second stage can be drilled more quickly and, being lighter, the second casing (3) can reach greater depths without compromising the stability of the base.

Drilling and running of the liners, as described below, takes place in a second stage.

A first phase is put into effect, comprising drilling and running a first liner (4) having a typical outside diameter of 11¾ inches (29.85 cm). Then follows a second phase comprising drilling and running a second liner (5) having a typical outside diameter of 9⅝ inches (24.45 cm).

This procedure used in both the first and the second phases differs from the procedure used in the drilling of a conventional well, which in these stages uses casing which extends from its terminal point within the well to the wellhead.

A third phase is then put into effect, comprising drilling and running a third liner (6) typically having an outside diameter of 7 inches (17.78 cm). This is the final stage, and is identical to the final stage in the drilling of a conventional well.

It should be pointed out that, for the purposes of simplifying the description, no technique for drilling the various stages in the well has been described here, as these are very well known to those skilled in the art, and in addition to this do not form an integral part of this invention.

Likewise, as was mentioned in the description of the prior art illustrated in FIG. 1, the method by which the various liners (4, 5, 6) are fixed to the casing (3) or liners (4 or 5) of immediately greater diameter is not described here, because this is a procedure well known in the art which therefore requires no description.

FIG. 2 also shows a blow-out preventer (BOP) (8) located at the lower end of riser (7) which is connected to the wellhead region (9).

It should be pointed out that the diameters of the liners (4, 5, 6) mentioned above cannot be regarded as limiting the application of this method, but have been mentioned for a better understanding of the smaller size of the intermediate diameters which can actually be obtained. In addition to this, these types of casing (2 and 3) are those usually found on the market for use in drilling operations but not used with the method of this invention. Equally the liners 4 and 5 are readily available for use in other well completion operations. It should also be pointed out that this reduction from the diameter normally used for casings for ultra deep water operation, together with a corresponding reduction in the diameter of the riser (7), fulfils the purpose of this method, which is to reduce costs and increase the availability of equipment for drilling wells in ultra deep water.

It should also be mentioned that the number (three) of stages of suspended intermediate liners (4, 5,6) is not limited to that mentioned above, and should not in any way be regarded as restricting this invention.

The method according to this invention permits wells of smaller intermediate diameters to be drilled and completed, with the replacement of some intermediate casing by liners. These wells can operate with, for example, risers of 14 inches (35.56 cm) outside diameter, much less than the 53.34 cm (21 inches) outside diameter drilling riser used in the prior art, thus reducing the need for increasing the buoyancy of the vessels used in order to take into account the extra depth of the well below the sea surface with deeper water operations. This means that, with minor adaptations, existing vessels can operate in deep waters, even at depths in excess of 1,000 m. (Well completion at depths in excess of 2,000 m is considered viable with this invention without needing to increase greatly the buoyancy of the drilling vessel.) In general, the casing 3 is considerably smaller than the casing 13 used in the prior art method, and likewise liners 4 and 5 are considerably smaller than the respective casings 14 and 15 used in the prior art method. In particular, the liners 4 and 5 are less than 13.56 cm (21 inches) outside diameter so as to be small enough to pass through the drilling riser. This means that, with minor adaptations, existing vessels can operate in ultra deep waters (more than thereby 1,000 m) thereby doing away with the need of ultra deep water drilling rigs, and consequently drastically reducing the drilling costs.

Apart from the reduction in internal diameter, the smaller diameter wellhead has the same external profile as the conventional 16¾ inch (42.55 cm) outside diameter wellheads currently in use. It can also be dimensioned to support a riser of, for example, 21 inches (53.34 cm) outside diameter so as not to confer any restrictive nature on the technique used, such as that of only operating with risers of smaller outside diameters such as 14 inches (35.56 cm).

What is claimed is:

1. A method for drilling and completing an oil well of small intermediate diameter in a sea bed in ultra deep water, comprising:

a first stage of drilling and running at least two casings into the seabed, a first said casing extending from a surface of the seabed to a first depth in the seabed, a second said casing extending from said surface of said seabed to a second depth in said seabed, said second depth being greater than said first depth, said second casing having a diameter less than a diameter of said first casing; and a second stage of drilling and running following said first stage, said second stage of drilling and running including drilling and running at least two suspended liners, a first end of a first said liner being fixed to a lower end of a last of said casings from said first stage of drilling and running, and a first end of a second said liner being fixed to a lower, second end of said first liner, said first liner being of larger diameter than said second liner, wherein said first stage consists essentially of drilling and running solely first and second casings whereby said first stage of drilling and running casings comprises the following steps:

drilling and running the first casing; and drilling and running the second casing;

wherein said first liner is fixed to the lower end of said second casing; and wherein said first casing has an outside diameter of about 30 inches (76.2 cm) and said second casing has an outside diameter of about 13⅜ inches (33.97 cm).

2. A method according to claim 1, wherein said second stage includes drilling and running at least a third liner, a first end of said third liner being fixed to a second, lower end of said second liner, and depending downwardly therefrom.

3. A method according to claim 2, wherein said first liner has an outside diameter of 11¾ inches (29.85 cm), said second liner has an outside diameter of ⅝ inches (24.45 cm) and said third liner has an outside diameter of 7 inches (17.78 cm).

4. A method according to claim 1 wherein each said liner is sized so as to be able to pass through a casing having an internal diameter of 53.34.

5. A method according to claim 1, wherein said second stage of drilling and running liners comprises the following steps:

drilling and running the first liner;

drilling and running the second liner; and drilling and running a third liner, wherein said third liner is fixed at a first end there of to a lower, second end of said second liner and depends downwardly therefrom.

6. A method according to claim 5, wherein said first liner has an outside diameter of 11¾ inches (29.85 cm), said second liner has an outside diameter of ⅝ inches (24.45 cm) and said third liner has an outside diameter of 7 inches (17.78 cm).

* * * * *